US007546843B2

(12) United States Patent
Boos et al.

(10) Patent No.: US 7,546,843 B2
(45) Date of Patent: Jun. 16, 2009

(54) REMOVAL OF HARDENED CONCRETE FROM READY MIXED DRUM INTERIORS USING UPWARDLY DIRECTED HIGH PRESSURE WATER

(75) Inventors: Frederick A. Boos, Temple Terrace, FL (US); Scott F. Boos, Tampa, FL (US); Michael W. Charo, Lithia, FL (US)

(73) Assignee: Blasters, LLC, Tampa, FL (US)

( * ) Notice: Subject to any disclaimer, the term of this patent is extended or adjusted under 35 U.S.C. 154(b) by 146 days.

(21) Appl. No.: 11/535,790

(22) Filed: Sep. 27, 2006

(65) Prior Publication Data

US 2007/0079852 A1 Apr. 12, 2007

Related U.S. Application Data

(63) Continuation-in-part of application No. 11/240,117, filed on Sep. 30, 2005.

(51) Int. Cl.
*B08B 9/00* (2006.01)

(52) U.S. Cl. ..... 134/166 R; 134/123; 134/167 R; 134/167 C; 134/168 C; 134/171; 134/172; 137/615

(58) Field of Classification Search ..... 134/24, 134/123, 166 R, 167 R, 172, 22.1, 22.18, 134/167 C, 168 C, 171; 137/615
See application file for complete search history.

(56) References Cited

U.S. PATENT DOCUMENTS 3,707,990 A * 1/1973 Schaible et al. ..... 137/615
3,893,480 A * 7/1975 Dunbar ..... 137/615
4,407,472 A * 10/1983 Beck ..... 248/89
4,548,236 A * 10/1985 Bloomquist ..... 137/615
4,805,653 A * 2/1989 Krajicek et al. ..... 134/166 C
5,244,498 A 9/1993 Steinke
5,377,913 A * 1/1995 Van Der Woude ..... 239/227
5,594,973 A * 1/1997 Brusseleers et al. ..... 15/304
6,418,948 B1 7/2002 Harmon
6,640,817 B2 11/2003 Harmon
6,698,451 B2 * 3/2004 Anderson et al. ..... 137/615
6,871,658 B2 * 3/2005 Gjestvang ..... 134/167 R
6,983,763 B2 * 1/2006 Benckert et al. ..... 137/615
2007/0079852 A1 * 4/2007 Boos et al. ..... 134/166 R

* cited by examiner

*Primary Examiner*—Michael Barr
*Assistant Examiner*—Rita R Patel
(74) *Attorney, Agent, or Firm*—Ronald E. Smith; Smith & Hopen, P.A.

(57) ABSTRACT

Residual concrete in the drum of a ready mixed concrete truck is removed by high-pressure water. A nozzle is mounted on the leading end of a torpedo-shaped nozzle housing that is hingedly mounted to an elongate boom. The boom enters the mouth of the drum at an angle that matches the angle of the drum. The hinge allows the nozzle housing to pivot with respect to the elongate boom so that the nozzle is close to the residual concrete. The boom is retracted toward the mouth with the drum rotating in the mix direction and the nozzle oscillating so that it cuts through a swath of concrete. As the boom retracts, the torpedo-shaped nozzle housing maintains the nozzle close to the residual concrete on the drum and both sides of the helical fins. The nozzle sweeps an arc from about eighty to one hundred twenty degrees as it oscillates.

20 Claims, 12 Drawing Sheets

REMOVAL OF HARDENED CONCRETE FROM READY MIXED DRUM INTERIORS USING UPWARDLY DIRECTED HIGH PRESSURE WATER

CROSS-REFERENCE TO RELATED DISCLOSURES

This disclosure is a continuation-in-part of U.S. patent application Ser. No. 11/240,117, filed by the same inventors on Sep. 30, 2005, having the same title as this disclosure.

BACKGROUND OF THE INVENTION

1. Field of the Invention

This invention relates, generally, to methods for removing concrete from the inside of ready mixed concrete truck drums. More particularly, it relates to methods that do not require a worker to enter into the drum, thereby protecting the worker from various occupational hazards.

2. Description of the Prior Art

Ready mixed concrete drums are rotatably mounted on concrete trucks so that the concrete in the drum can be continuously mixed, typically with the drum rotating in a clockwise direction, as it is transported from a concrete batching facility to a job site. Upstanding helical fins or blades are mounted on the interior walls of the rotating drum so that concrete at the closed end of the drum is driven to the open end of the drum when the drum is rotated in a counterclockwise, discharge direction. The helical fins or blades act as an auger, urging the concrete towards the trailing end of the drum when the drum is in said discharge mode. The helical fins or blades urge the concrete toward the cab of the truck when the drum is rotating in the clockwise, mixing direction.

Some ready mixed concrete trucks are front-discharging. The mixing and discharging modes are reversed relative to rear-discharge trucks.

It is inevitable that some concrete will remain within the drum after each load of concrete has been discharged. Over time, the drum is laden with residual concrete that gradually builds up, substantially increasing the weight of the truck when empty and substantially reducing the volume of concrete that the truck can legally haul. The residual concrete also adversely affects the quality of the ready mixed concrete carried by the truck. Some companies combat this problem by attempting to clean the drum at the end of each work day, before the build-up becomes severe. Others just wait until the problem becomes acute.

The conventional way to clean hardened concrete out of a ready mixed concrete drum is to position a worker inside the drum. The worker operates a pneumatic chipping hammer to break the concrete into chips that can be removed. The shortcomings of this well-known procedure are many—the entry into the work space is confined and therefore requires confined space entry permitting, the worker may experience eye injuries, tripping or slipping and falling, and exposure to silica and other harmful particles as the concrete is chipped. Moreover, the worker's hearing is adversely affected in view of the small size of the confined space where the pneumatic chipping hammer is operated, the worker may damage the truck drum and the helical fins or blades when breaking through a chunk of concrete, and so on. Moreover, such workers are paid by the weight of the concrete that they remove. This fact, coupled with the fact that the small workspace is claustrophobic, results in the worker typically leaving small, relatively light pieces of hardened concrete behind. These small pieces act like concrete magnets when new concrete is charged into the drum—they quickly bond with the new concrete, grow rapidly in size and the cycle begins again, forcing another inefficient pneumatic hammer cleaning.

Several inventors have addressed the problem. U.S. Pat. Nos. 6,418,948 and 6,640,817 to Harmon disclose an elongate wand having a plurality of nozzles at its leading end. The nozzles are aimed so that they cause water under pressure to impinge upon the back surface of the helical fins or blades as the wand is inserted into the drum. No cleaning takes place when the wand is retracted from the drum because the flow of water stops when the leading end of the wand contacts the forward, closed end of the drum. The wand does not clean the front side of the helical fins or blades. Moreover, the wand is positioned on the axis of rotation of the drum so that the nozzle is close to the concrete only at the opposite ends of the drum, i. e., at the closed leading end and the open, discharge end. The Harmon wand is positioned in coincidence with the rotational axis of the drum so that it does not come into contact with the helical fins or blades.

The Harmon nozzles are several feet from the residual concrete at the center of the drum because the diameter of the drum is greatest at its center. The efficiency of the cleaning drops off sharply as the distance between the nozzles and the concrete, known in the industry as the stand-off distance, is increased. The nozzles are therefore least effective at the center of the drum because the stand-off distance is greatest at said center.

Two other patents that disclose means for directing high pressure water against the back surface of the helical fins or blades are U.S. Pat. No. 5,244,498 to Steinke and Swedish Patent No. 8802328-8 to Sverige.

Multiple nozzles are not as effective as a single nozzle for cutting concrete. What is needed, then, is a single, oscillating nozzle that cleans concrete from the sidewalls of the drum between the fins or blades, and also from both sides of the fins or blades, not just the back side.

There is also a need for a nozzle that remains at an effective stand-off distance to the concrete to be removed at all times.

The helical fins or blades represent an obstacle to fulfillment of such need. A more specific need exists, accordingly, for a nozzle that remains at a predetermined, highly efficient stand-off distance from the hardened concrete despite the helical fins or blades so that residual concrete is attacked with greater energy.

Instead of finding a way to position a nozzle close to the residual concrete during the cleaning process, the prior art positions the nozzle along the longitudinal axis of symmetry of the drum at all times and uses high water pressure in an ineffective attempt to blast off residual concrete from a relatively long distance.

What is needed is a system that cleans the drum thoroughly, not leaving behind small pieces of concrete that act as magnets or seeds for rapid residual concrete accumulation. The needed system should clean both sides of the helical fins or blades as well, and should do so with the lowest flow rate and water pressure required so as to conserve resources.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for a means for cleaning residual concrete from the inside of a ready mixed concrete drum having helical fins or blades therewithin is now met by a new, useful, and non-obvious invention.

The novel apparatus includes an upstanding tube-in-tube tower and a motor mount housing having a hollow interior. The motor mount housing is positioned in surmounting relation to the upstanding tower. An elongate nozzle boom housing of generally straight or linear configuration has a hollow interior and open ends and is mounted in surmounting relation to the motor mount housing. The elongate nozzle boom housing is adapted to receive an elongate nozzle boom and is pivotally mounted with respect to the motor mount housing. The elongate nozzle boom housing has a position of repose where a longitudinal axis of the elongate nozzle boom housing is disposed normal to a longitudinal axis of the upstanding tower.

The elongate nozzle boom is ensleeved at least in part within the hollow interior of the elongate nozzle boom housing. The elongate nozzle boom has a leading end extending from a leading end of the elongate nozzle boom housing, a trailing end extending from a trailing end of the elongate nozzle boom housing, and a medial extent ensleeved within the elongate nozzle boom housing.

The elongate nozzle boom has a fully retracted position where the trailing end of the elongate nozzle boom is remotely disposed relative to the elongate nozzle boom housing and where the leading end of the elongate nozzle boom is disposed in close proximity to the elongate nozzle boom housing.

The elongate nozzle boom has a fully extended position where the trailing end of the elongate nozzle boom is disposed in close proximity to the elongate nozzle boom housing and where the leading end of the elongate nozzle boom is remotely disposed in relation to the elongate nozzle boom housing.

There are an infinite number of positions between the fully retracted position and the fully extended position. Moreover, the elongate nozzle boom may travel at an infinite number of speeds, an infinite number of time delays, and an infinite number of combinations of speeds and time delays.

A torpedo-shaped nozzle housing is pivotally connected to the leading end of the elongate nozzle boom so that the torpedo-shaped nozzle housing is automatically positionable in an infinite number of angular positions relative to the longitudinal axis of the elongate nozzle boom. The torpedo-shaped nozzle housing has a storage and insertion position where it is disposed in substantially linear alignment with the elongate nozzle boom.

An interconnecting means such as a hinge interconnects the torpedo-shaped nozzle housing and the elongate nozzle boom and a control means controls the instantaneous angular position of the torpedo-shaped nozzle housing relative to the elongate nozzle boom. The control means preferably includes a hydraulic cylinder. However, a control means of pneumatic, electrical, electromechanical, manual, or other means is within the scope of this invention.

A high-pressure water nozzle in fluid communication with a source of water under high pressure is mounted near the leading end of the torpedo-shaped nozzle housing. In a preferred embodiment, the water pressure is greater than fifteen thousand pounds per square inch (15,000 lbs/in$^2$).

The high-pressure water nozzle is mounted for oscillation along a longitudinal axis of the elongate nozzle boom. The drum of the ready-mixed concrete truck rotates in a transverse direction relative to the longitudinal axis of the drum. Accordingly, the longitudinal oscillation of the nozzle cuts a swath of concrete that is adjustable in speed and length of stroke as the drum rotates, thereby reducing the amount of time, relative to a non-oscillating nozzle, required to complete a cleaning job. The longitudinal extent of the swath is determined by the angular sweep of the nozzle. The transverse extent of the swath per unit of time is determined by the angular velocity of rotation of the drum. A non-oscillating nozzle would cut a pencil thin, transversely disposed line through the concrete as the drum rotates.

The longitudinal oscillation of the nozzle and the ability of the torpedo-shaped nozzle housing to be angled with respect to the elongate nozzle boom ensures that both sides of the helical fins or blades are cleaned, not just one side thereof. The drum between the fins or blades is cleaned as well. The ability of the nozzle to maintain an ideal spacing from the residual concrete also ensures that residual concrete can be removed efficiently at relatively low flow rates and water pressures, thus conserving resources.

Rotation of the ready mixed concrete drum in a direction adapted to mix concrete, coupled with discharge of high pressure water from the oscillating high pressure water nozzle during such rotation, causes separation of residual concrete from an interior surface of the ready mixed concrete drum because the oscillating high pressure water nozzle is positioned closely to the side walls of the drum or closely to the helical fins or blades at all times. Water and residual concrete that has been blasted from the walls and the helical fins of the drum are thus urged forwardly during the mix-mode turning of a rear-discharge drum. The water and free residual concrete is thus retained within the drum as long as the drum remains in the mix mode or is stopped.

After the residual concrete has been blasted from the sidewalls of the drum and both sides of the fins or blades, the drum is rotated in the discharge direction. This causes the helical fins or blades, acting as an auger, to discharge the water and the residual concrete removed by the action of the high pressure water.

An elongate rack gear is secured to an underside of the elongate nozzle boom so that movement of the elongate rack gear effects conjoint movement of the elongate nozzle boom. The elongate rack gear and the elongate nozzle boom extend through the elongate nozzle boom housing. A pinion gear is disposed in meshing engagement with the elongate rack gear so that rotation of the pinion gear in a first direction extends the elongate nozzle boom and rotation in a second direction retracts the elongate nozzle boom.

A motor, preferably hydraulic, has an output shaft and is mounted on the motor mount housing, externally thereof. The pinion gear is mounted on the output shaft of the motor for conjoint rotation therewith and is positioned within the hollow interior of the hydraulic motor mount housing. The motor is reversible so that the pinion gear may rotate in either direction, thereby extending or retracting the elongate nozzle boom. A visual retraction rate indicator is attached to the pinion gear shaft for setting of time delays and retraction speed. The visual retraction indicator is provided in the form of a circular disc that is divided into fourteen segments having a common size.

The upstanding tower has a tube-in-tube construction so that the height of the tower is adjustable from a fully extended elevated position to a fully retracted low position and an infinite plurality of positions therebetween. The tube-in-tube construction includes a stationary lower tube and a movable upper tube that is moved telescopically in relation to the stationary lower tube by preferably hydraulic means.

A hinge means hingedly interconnects the upstanding upper tube and the elongate nozzle boom which is horizontally disposed when in repose. The hinge means includes a top plate disposed in surmounting relation to the upper tube and a support plate disposed in underlying relation to the elongate nozzle boom. The hinge means hingedly interconnects the top plate and the support plate. When the support plate is disposed at an angle relative to the top plate, the elongate nozzle boom is disposed at the same angle relative to a horizontal plane.

A hydraulic cylinder is disposed in interconnecting relation to the motor mount housing and the upper tube. A first end of the hydraulic cylinder is pivotally connected to a leading end of the motor mount housing and a second end of the hydraulic cylinder is pivotally secured to the upper tube. Extension of the hydraulic cylinder causes pivotal movement of the motor mount housing and the elongate nozzle boom and full retraction of the hydraulic cylinder positions the motor mount housing and the elongate nozzle boom in a horizontal plane. The angle of inclination of the elongate nozzle boom matches the angle of inclination of the ready mix drum when the cleaning operation is performed.

An oscillating means causes the pivotally-mounted nozzle to oscillate about its pivot point as it dispenses high pressure water as mentioned above. The oscillating means includes a hydraulic motor having an output shaft to which is mounted a disc. A first end of a rigid link is mounted to the disc and a second end of the rigid link is mounted to the nozzle in spaced relation to the pivot point so that the nozzle oscillates as the disk rotates.

The elongate nozzle boom has an unpivoted position of repose where it is disposed substantially horizontally as aforesaid, a first pivoted position where it is disposed at an angle of about seventeen degrees (17°) relative to a horizontal plane, and a second pivoted position where it is disposed at an angle of about thirty-four degrees (34°) relative to a horizontal plane. It should be understood, however, that it can be placed into any inclination. In a preferred embodiment, the angle of inclination is controlled by one or more hydraulic cylinders and thus there are an infinite number of inclined positions to match the various configurations of trucks into which the elongate boom may be placed.

An important advantage of the novel apparatus and method is that all residual, fully or partially cured concrete is removed from the interior of a ready mixed concrete drum without causing damage to the drum or the helical fins or blades. Significantly, both sides of the helical fins or blades are cleaned, not just the back side. The cleaning of both sides of the helical fins or blades, as well as the head and the interior of the drum, heretofore never accomplished, is a function of the oscillation of the nozzle as well as the torpedo assembly that maintains an effective stand-off distance at all times. The effective stand-off distance is maintained by allowing the torpedo to gently slide over each of the fins or blades as they are encountered as the torpedo is slowly retracted from the drum. The smooth shape of the torpedo prevents it from being snagged on any fin or blade.

Another important advantage is that the novel structure and method eliminates the need for a worker to enter the drum for the purpose of cleaning it. The use of hand-held devices such as jackhammers or vibrators is therefore eliminated. Some residual concrete is so hard that precision blasting with dynamite has been employed. The novel system also eliminates the need for such hazardous methods.

Moreover, no chemicals or retarding agents are required. The magnets and proximity sensors of the prior art are also eliminated.

Still another advantage is that the pressure and flow forces generated by the novel apparatus hydraulically lifts concrete from the drum with its impingement forces, i.e., the residual concrete is not just worn or blasted away from the steel drum.

Moreover, the energy required to accomplish the cleaning is minimized by positioning the nozzle near the concrete at all times.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1A:
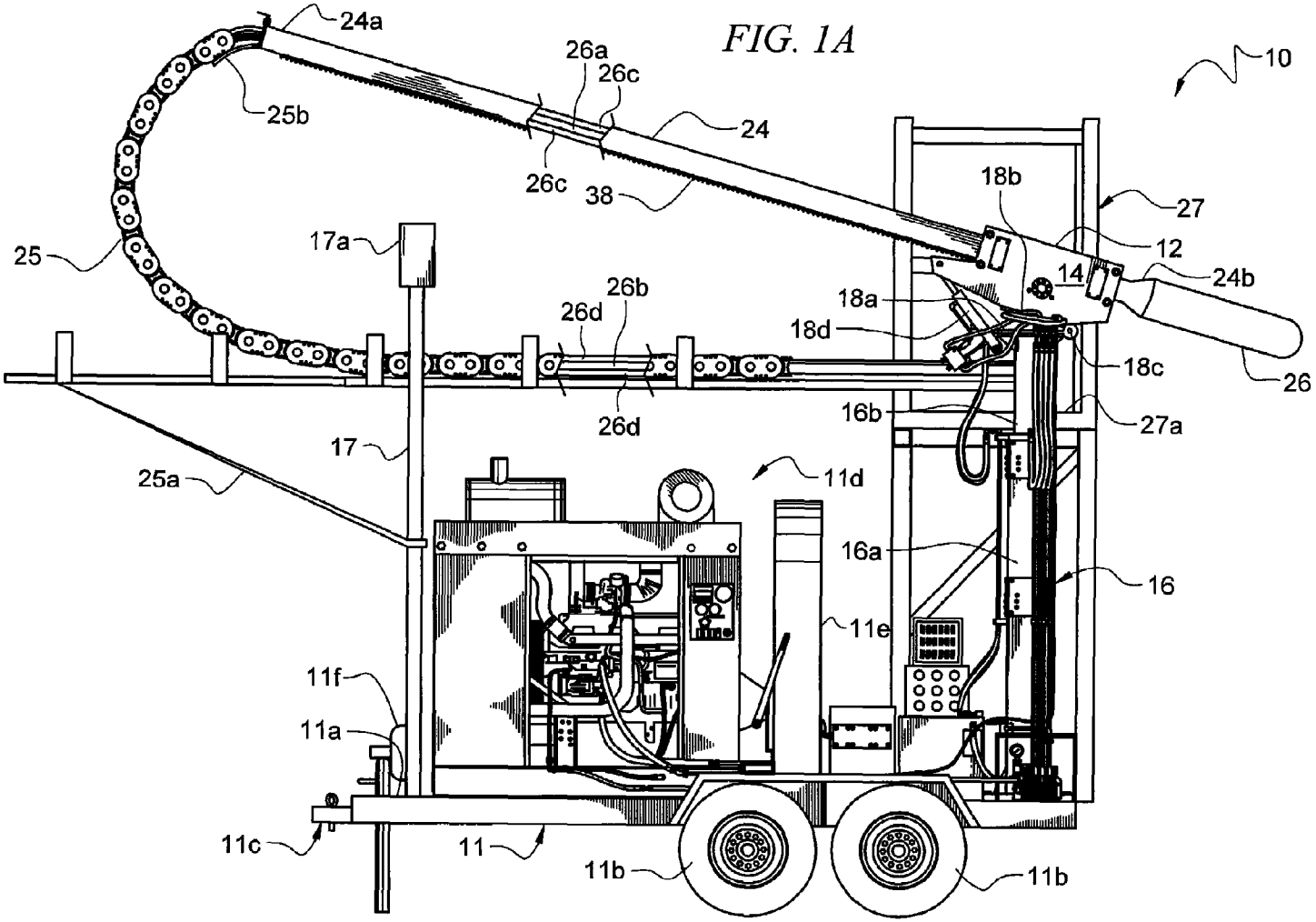
FIG. 1A is a side elevational view of the novel apparatus.

Referring now to FIG. 1A, it will there be seen that an illustrative embodiment of the invention is denoted as a whole by the reference numeral 10. FIG. 1A depicts trailer 11 having trailer bed 11*a*, wheels 11*b*, hitch assembly 11*c*, diesel engine 11*d*, pump belt guard 11*e*, and diesel-powered water booster pump 11*f*.

Hollow housing 12 is mounted atop hydraulic motor mount assembly 14 and said hydraulic motor mount assembly 14 is disposed in surmounting relation to tower 16. Tower 16 includes lower tube 16*a* that telescopically receives movable upper tube 16*b* therewithin so that the height of tower 16 is adjustable. The telescopic movement is preferably controlled by an internal hydraulic cylinder, not depicted.

A hinge assembly surmounts upper tower 16*b*. Top plate 18*a* surmounts upper tower 16*b*, and support plate 18*b* is hingedly secured to top plate 18*a* by hinge 18*c*. Hydraulic motor mount assembly 14 is mounted atop said support plate 18*b*. Hinge assembly is depicted in a position rotated about twenty degrees (20°) upwardly relative to a horizontal plane. Hydraulic cylinder 18*d* is connected between upper tube 16*b* and hydraulic motor mount assembly 14 and is operative to pivot support plate 18*b* about hinge 18*c* relative to top plate 18*a*.

Hollow housing 12 ensleeves elongate nozzle boom 24. An inclinometer is mounted to elongate nozzle boom 24 to determine the insertion angle required, said angle being about seventeen degrees (17°), plus or minus ten degrees (10°) for most trucks. This insertion angle is a function of the angle of tilt of the drum of a ready mixed concrete truck. Significantly, the novel apparatus performs its functions equally well with either front-discharge or rear-discharge ready mixed concrete trucks.

Elongate nozzle boom 24 extends through the hollow interior of hollow housing 12 as aforesaid. End 24*a* of elongate nozzle boom 24 is the leading end of elongate nozzle boom 24 and end 24*b* is the trailing end of said elongate nozzle boom. An unnumbered extent of said elongate nozzle boom is ensleeved within said hollow housing.

Upstanding post 17 is surmounted by saddle 17*a* that supports elongate nozzle boom 24 when said elongate nozzle boom is in its horizontal, stored position.

Elongate nozzle boom 24 is mounted atop elongate rack gear 38 and is secured thereto for conjoint displacement therewith. As more fully disclosed in the incorporated disclosure, a pinion gear disposed within hydraulic motor mount assembly 14 meshingly engages elongate rack gear 38 on an underside thereof. The pinion gear is secured to an output shaft of a reversible hydraulic motor so that rotation of the output shaft in a first direction causes retraction (leading-to-trailing displacement) of elongate nozzle boom 24 and rotation of said output shaft in a second direction opposite to said first direction causes extension (trailing-to-leading displacement) of said elongate nozzle boom. Boom 24 is fully retracted in its FIG. 1A configuration. The boom is fully retracted prior to insertion into the hollow interior of a ready mixed concrete drum through the opening at the trailing end of the drum for a rear-discharging truck. Elongate nozzle boom 24 enters the opening at the leading end of a forward-discharging truck.

Torpedo-shaped nozzle housing 26 is hingedly secured to the leading end of elongate nozzle boom 24 and is in axial alignment therewith when in its position of repose.

Water under high pressure is supplied to torpedo-shaped nozzle housing 26 by an elongate, flexible hose, a leading end of which is denoted 26*a* in FIG. 1A and is carried within elongate boom 24 and a trailing end of which is denoted 26*b* in FIG. 1A and is carried within hose handler 25. A suitable hose handler is commercially available under the trademark Gortrac® cable and hose carriers, available from A & A Mfg. Co., Inc. of New Berlin, Wis. (www.gortrac.com). Brace 25*a* provides support for said hose handler. Arcuate, flexible metal plate 25*b* is secured to the trailing end of elongate nozzle boom 24 and supports hose handler 25 at the point where plural hoses extend into and retract from said elongate nozzle boom.

A first plurality of hydraulic hoses 26*c* and first high pressure water hose 26*a* are housed within elongate nozzle boom 24. A second plurality of hydraulic hoses 26*d* and a second high pressure water hose 26*b* are housed within hose handler 25. The first and second plurality of hydraulic hoses and the first and second high pressure water hoses are respectively connected to one another at a trailing end of elongate boom 24. Elongate, flexible hose handler 25 has a leading end disposed in close proximity to the trailing end of elongate boom 24.

Figure 1B:
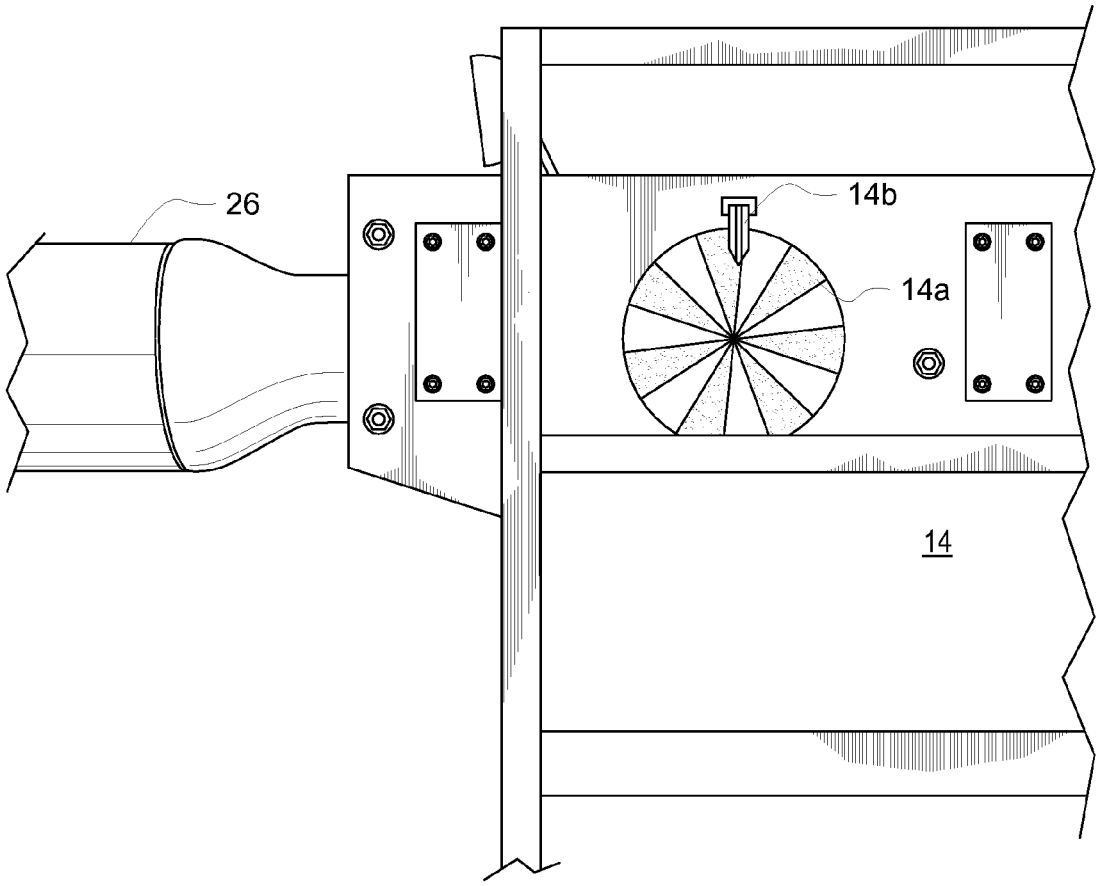
FIG. 1B is a detailed side elevational view of the hydraulic motor mount housing.

FIG. 1B depicts visual retraction indicator 14*a* provided in the form of a circular disc that is mounted for rotation on the pinion gear shaft that controls elongate rack gear 38. The angular velocity of rotation of indicator 14*a* is therefore determined by the linear speed of said rack gear. Pointer 14*b* is mounted on hydraulic motor housing 14 and is stationary. Disc 14*a* is divided into a plurality of segments having a common size. In this particular embodiment, the number of segments is 14 as depicted but that number is not critical. The segments are preferably of two differing colors that alternate with one another so that each segment has a color different from its contiguous segments. An operator observing the rotation of disc 14*a* may adjust the linear speed of elongate nozzle boom 24 based upon the angular velocity of the disc. Visual retraction indicator 14*a* thus facilitates the setting of time delays for insertion and retraction speeds.

Figure 2:
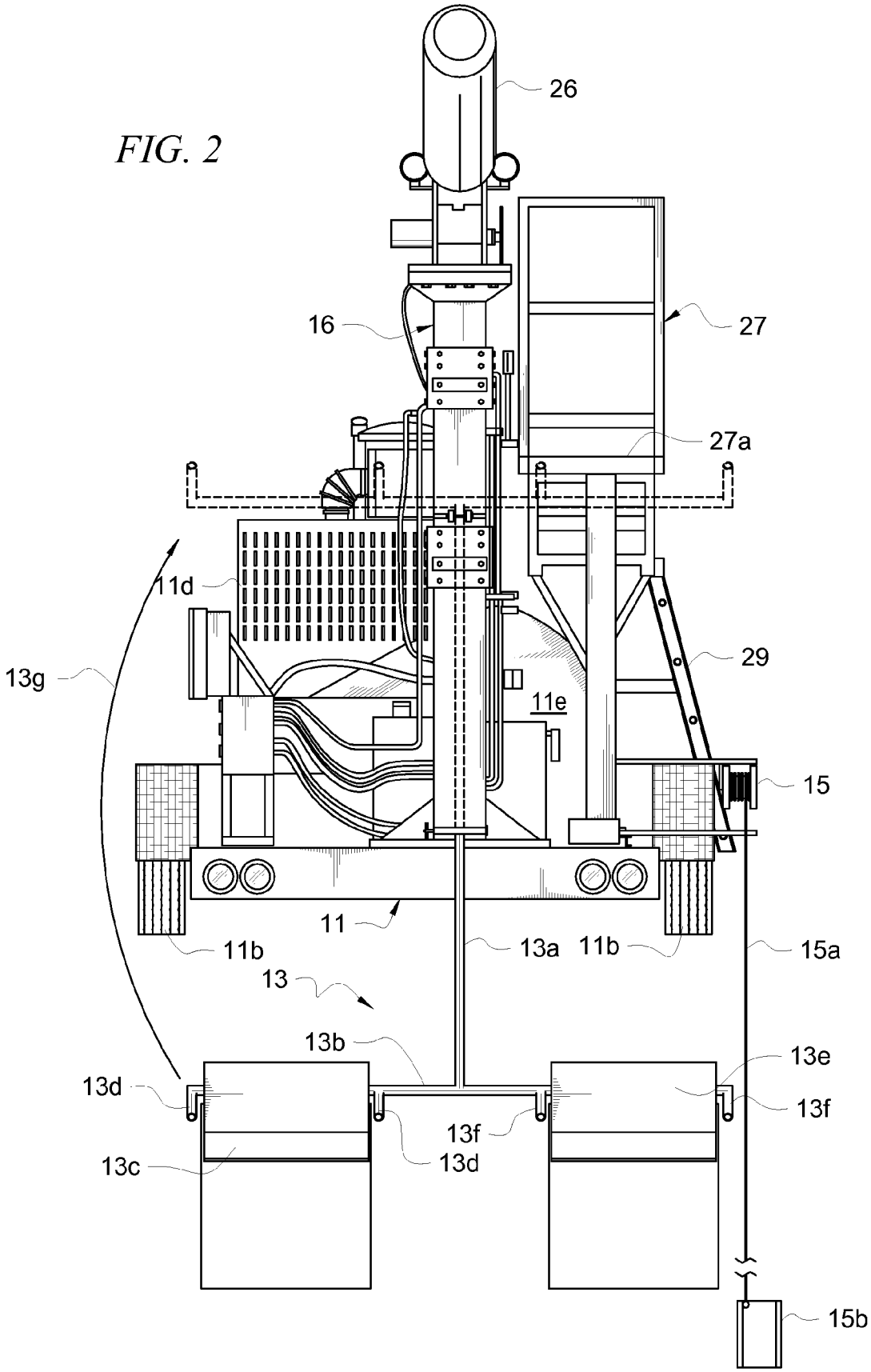
FIG. 2 is an end perspective view depicting the backup assistance assembly for aligning a cement truck and the novel apparatus.

Observation tower 27 includes platform 27*a* upon which the apparatus operator may stand. The elevated height provides an unobstructed view into the interior of the truck being cleaned. Ladder 29, depicted in FIG. 2, is hingedly mounted to the trailer frame at its top so that it can be deployed as depicted in FIG. 2 and folded into a storage configuration when not in use. Two (2) hydraulic flow control microvalves are mounted on the observation tower. A first control means controls the oscillation speed of the nozzle and a second control means controls the retraction speed of elongate nozzle boom 24.

FIG. 2 also depicts an assembly of parts that facilitates the cooperative alignment of novel trailer 11 to a ready mixed cement truck. Back-up assistance assembly 13 includes a longitudinal rod 13*a* having a first end pivotally secured to a trailing end of trailer 11. (Torpedo-shaped nozzle housing 26 is positioned at the leading end of elongate boom 24 but it should be understood that said parts extend towards the trailing end of the trailer upon which they are mounted). Transverse rod 13*b* is connected to longitudinal rod 13*a* to form a "T"-shaped connection therewith. A first flat aluminum diamond plate having upwardly protruding first cast aluminum wheel chock 13*c* secured thereto is positioned between but not connected to truncate rods 13*d*, 13*d*, and a second flat aluminum diamond plate having upwardly protruding cast aluminum wheel chock 13*e* secured thereto is positioned between but not connected to truncate rods 13*f*, 13*f*, said truncate rods being formed integrally with transverse rod 13*b* and disposed at right angles thereto so that they overlie a road surface when deployed in their operable position as depicted. The driver of ready mixed cement truck 19 backs onto the flat plates until the wheels are stopped by the wheel chocks. The length of longitudinal rod 13*a* is preselected to ensure that the truck will be properly spaced from the novel apparatus when the wheels of the ready mixed concrete truck abut said wheel chocks.

To assist the driver in aligning with the trailer, a line reel 15 is rotatably mounted on the side of the trailer corresponding to the side of the truck where the driver sits and an elongate line 15*a* is played out from said reel to a pipe or plate 15*b* in parallel alignment with the common longitudinal axis of symmetry of truck 19 and trailer 11 up to a point where it can be seen by the driver. In this way, the driver aligns truck 19 with line 15*a* and plate 15*b* and backs-up until wheel chocks 13*c* and 13*e* are encountered. Elongate line 15*a* is then reeled back onto reel 15. After the cleaning operation, longitudinal rod 13*a* and hence transverse rod 13*b* are rotated into a storage position as indicated by displacement arrow 13*g* where longitudinal rod 13*a* is substantially upright as indicated by the dotted lines in FIG. 2. Hooks are mounted on tower 16 to engage said rods to prevent unwanted deployment of the back-up assistance assembly. The flat plates with chocks are stored in any suitable location.

Figure 3:
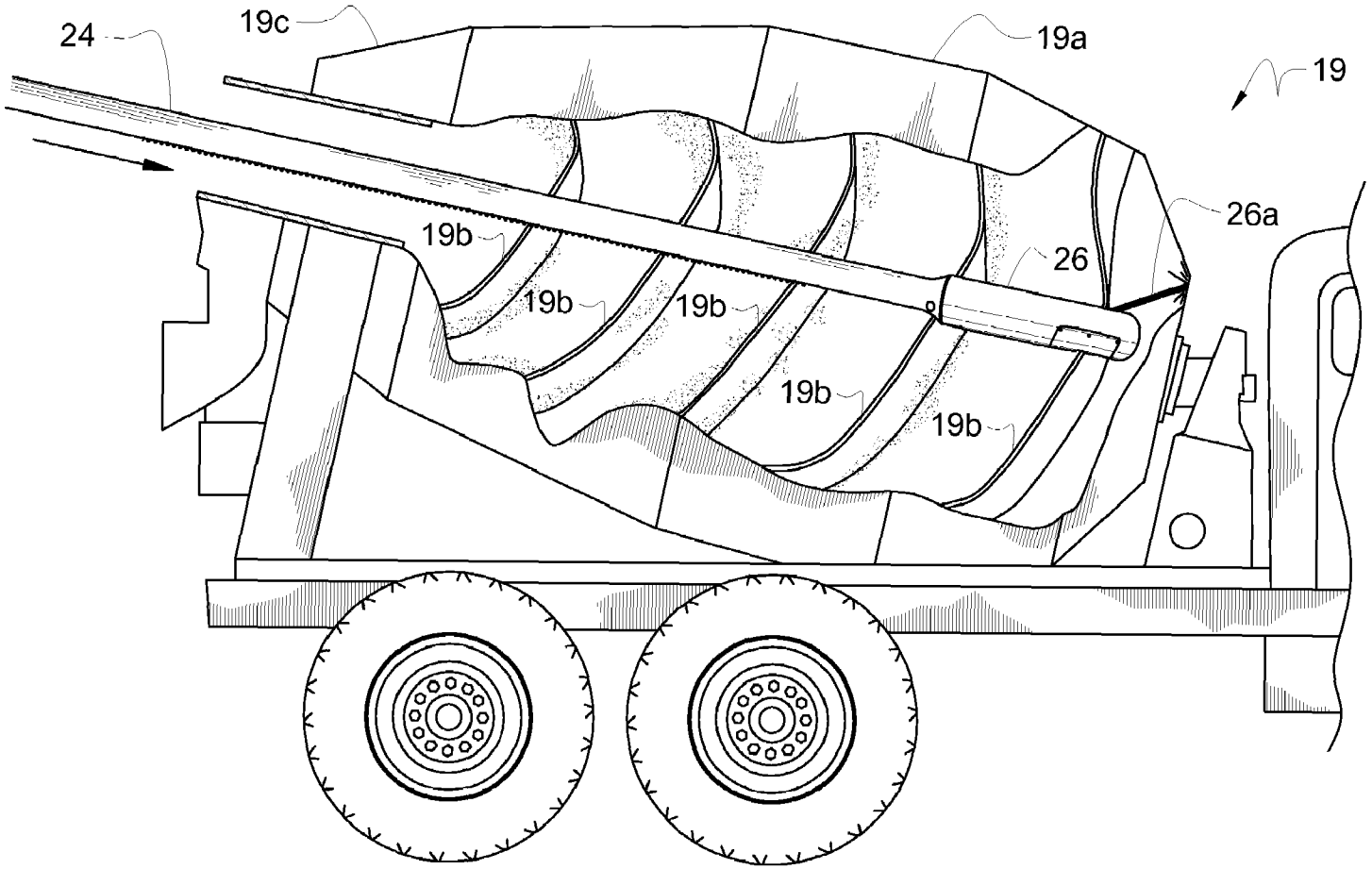
FIG. 3 is a side elevational cut-away view depicting the interior of a ready mixed concrete truck drum when the torpedo-shaped nozzle housing is fully inserted therein, cleaning the head and the front drum interior.

FIG. 3 depicts novel torpedo-shaped nozzle housing 26 when fully inserted into drum 19*a* of a ready mixed concrete truck 19 at the beginning of a cleaning operation. No water is normally ejected from the nozzle during the insertion procedure. Elongate nozzle boom 24 and hence torpedo-shaped nozzle housing 26 are retracted as drum 19*a* rotates. Water is ejected from the nozzle usually only during such retraction. The rate of retraction depends upon the amount of accumulation of residual concrete, with the rate decreasing as the accumulation increases. Residual concrete is removed from the sidewalls of drum 19*a* and both sides of helical fins or blades 19*b* within drum 19.

A commercial embodiment of the torpedo-shaped nozzle housing is pivotable with respect to elongate nozzle boom 24 by about thirty four degrees (34°), but this is not a critical limitation. Depending upon the size of drum 19*a*, elongate nozzle boom 24 is extended until torpedo-shaped nozzle housing 26 is positioned near the leading, closed end of said drum 19*a*, as depicted in FIG. 3, at the beginning of the cleaning procedure.

Figure 4:
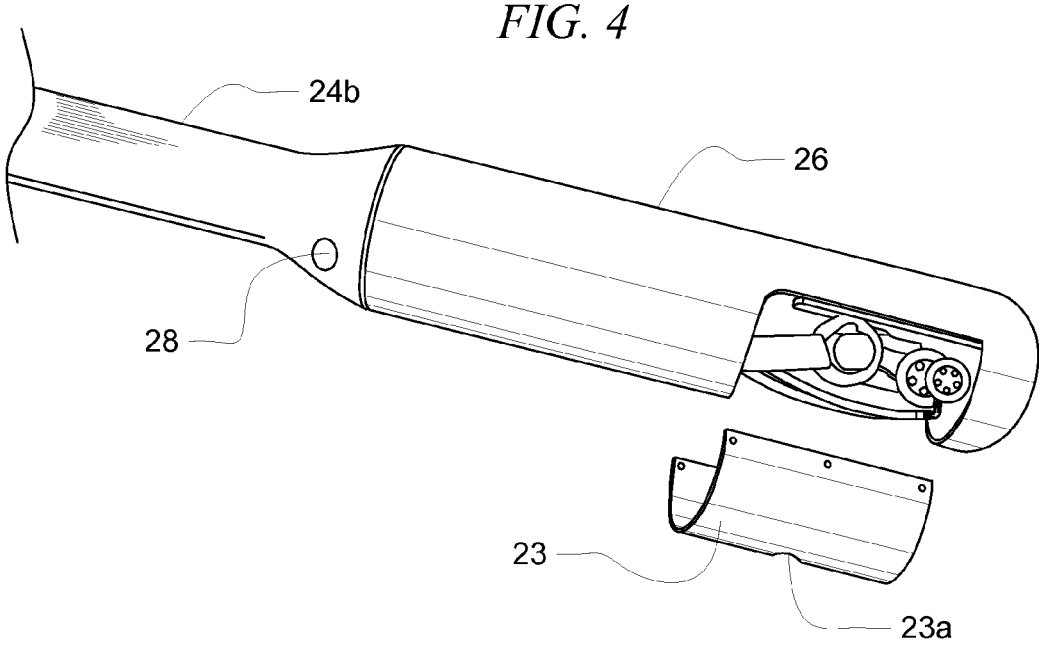
FIG. 4 is a side elevational exploded view depicting the cover of the novel torpedo-shaped nozzle housing in removed relation to said housing.

High-pressure water, denoted 26*a* in FIG. 4, is blasted from an adjustable nozzle, not depicted in FIG. 4, housed within torpedo-shaped nozzle housing 26 near the leading end thereof. The blast of high pressure water 26*a* may be directed upwardly in a vertical plane, i.e., at a twelve o'clock (12:00) position relative to said torpedo-shaped nozzle housing 26. However, it should be understood that such 12:00 position is not critical and that the flow axis of the nozzle may be positioned at eleven o'clock (11:00) or one o'clock (1:00), ten o'clock (10:00) or two o'clock (2:00), nine o'clock (9:00) or three o'clock (3:00) (both of which are horizontal positions), eight o'clock (8:00) or four o'clock (4:00), and so on, or at any angle therebetween, there being an infinite number of positions of functional adjustment. The torpedo-shaped nozzle housing may be mounted at any angle of rotation relative to the longitudinal axis of symmetry of elongate boom 24 and therefore the blast of high pressure water from its nozzle may be directed at any angle relative to the longitudinal axis of symmetry of elongate boom 24. The nozzle should not be oriented so that the water is directed at an accumulated pool of water at the bottom of the rotating drum, of course. The adjustable nozzle pivots forwardly and rearwardly, i. e., longitudinally, sweeping an arc between approximately eighty degrees to one hundred twenty degrees (80-120°) as water is ejected therefrom while drum 19*a* rotates. More particularly, the adjustable nozzle oscillates along a line substantially coincident with a longitudinal axis of symmetry of the ready mixed concrete drum.

For comparison purposes, it is noted that the high pressure blast of water is directed downwardly by the apparatus disclosed in the parent disclosure.

Drum 19*a* rotates in its "mix" direction during the blasting/cleaning procedure. In the parent disclosure, application Ser. No.11/240,117, the drum rotates in the "discharge" direction during the blasting/cleaning. The difference in drum rotation direction is a function of the upwardly-directed blast of water and enables the containment of water and debris within the drum during the blasting/cleaning operation.

The nozzle housing of the parent disclosure slides over helical fins or blades 19*b* as it is retracted. Torpedo-shaped nozzle housing 26 also slidingly engages said helical fins or blades as it is retracted. However, the torpedo shape enables such sliding contact to occur in the absence of snags. The Torpedo-shaped nozzle housing can also be used during the insertion procedure by placing the torpedo housing at a large backward angle (say 135 degrees) to that of the boom so that the torpedo housing slides over the helical fins or blades during the insertion procedure. In this case, the water is ejected from the nozzle usually during the insertion procedure.

There are two factors that affect the amount of hydraulic pressure required to cause torpedo-shaped nozzle housing 26 to glide gently or "float" over helical fins or blades 19*b* as they are encountered. The weight of torpedo-shaped nozzle housing 26 is the first factor and the reactive force of the water is the second. If the water is directed straight up, the reactive force is directed straight down, thereby effectively adding to the weight of torpedo-shaped nozzle housing 26. A spray directed to the one o'clock position produces a reaction in the seven o'clock direction with the downward component thereof being equal to the downward component of the straight down (6:00) component multiplied by the cosine of thirty degrees and so on. The two downwardly-directed forces (gravity and the reactive force) are combined and thus an upwardly-directed hydraulic pressure that substantially matches those two downwardly-directed forces is required if it is desired to maintain the nozzle in the center of the ready mixed concrete drum at all times. However, such positioning of the nozzle is not desired. Instead, this invention teaches the placement of the nozzle near the surface of the residual concrete whenever possible so that such residual concrete can be removed with lower pressure. Thus, the upwardly-directed force is selected to exceed the combined downwardly-directed forces of gravity and reaction. This causes torpedo-shaped nozzle housing 26 to be biased toward the top of the ready mixed concrete drum, thus placing the nozzle near the surface of the ready mixed concrete. Then, when torpedo-shaped nozzle housing 26 encounters a helical fin or blade 19*b*, said blade pushes the nozzle housing downwardly, thereby momentarily overcoming the upwardly-directed forces. However, upon clearing said fin or blade, torpedo-shaped nozzle housing 26 gently returns, in the absence of abrupt motion, to its upward position near the surface of the residual concrete. Thus it is said that the nozzle housing floats over the fins or blades.

Figure 5:
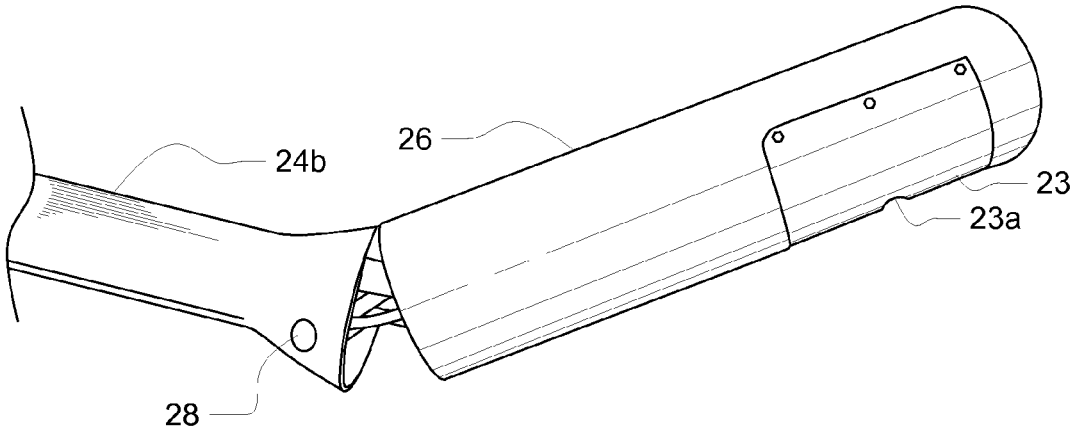
FIG. 5 is a side elevational view of the torpedo-shaped nozzle housing when said cover is closed and said housing is angled upwardly, in the float position, relative to the elongate boom.

As best understood in connection with FIGS. 4 and 5, torpedo-shaped nozzle housing 26 is hingedly mounted as at 28 to leading end 24*b* of elongate boom 24. A hydraulic cylinder controls the instantaneous position of torpedo-shaped nozzle housing 26. Full retraction of the hydraulic cylinder positions torpedo-shaped nozzle housing 26 in substantial axial alignment with elongate nozzle boom 24 as depicted in FIG. 4. Extension of said hydraulic cylinder positions torpedo-shaped nozzle housing 26 in a tilted or pivoted position relative to elongate boom 24 as depicted in FIG. 5. As the nozzle housing encounters a fin or blade 19*b*, the angle of inclination of said nozzle housing 24 is gradually decreased because of the sliding contact with said fin or blade, until said torpedo-shaped nozzle housing is flattened, i.e., in line with elongate nozzle boom 24. As a fin or blade 19*b* is cleared, the hydraulic pressure gently returns the nozzle housing to its upwardly-angled position so that the water under pressure is again at its closest spacing to the surface of the residual concrete. This action of torpedo-shaped nozzle housing 26 is referred to herein as a "floating" action because it gently slides over each helical fin or blade 19*b* as each fin or blade is encountered and returns to its optimal position near the residual concrete that lines the interior of the drum as each fin or blade is cleared. There are no abrupt movements due to the hydraulic float control disclosed in detail at the conclusion of this disclosure in connection with FIGS. 12A-C.

FIGS. 4 and 5 also depict removably mounted maintenance panel 23 having opening 23*a* formed therein. Panel 23 is secured to nozzle housing 26 as depicted in FIG. 5 when the novel apparatus is in operation but is easily removable as indicated in FIG. 4 to maintain and service the nozzle assembly area. Opening 23*a* allows water or other debris that may get into hollow torpedo-shaped nozzle housing 26 to drain therefrom while the apparatus is in operation.

Figure 6:
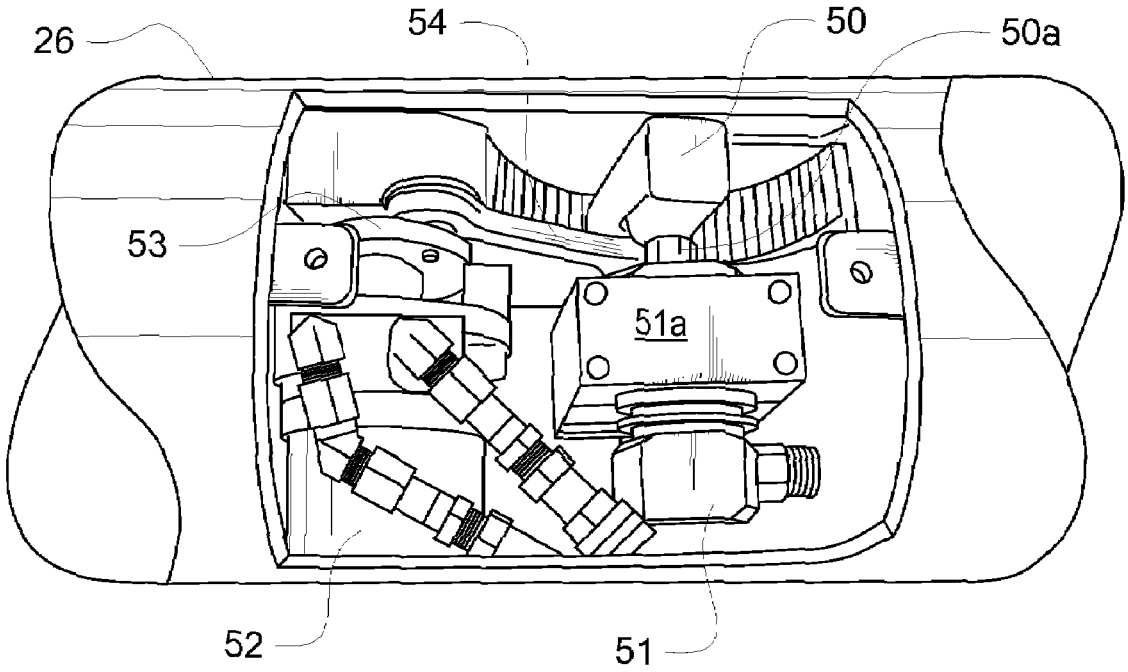
FIG. 6 is a perspective view depicting the assembly of parts that effects oscillation of the nozzle lance.

High-pressure water nozzle lance 50, depicted in FIG. 6, has a straight configuration. It oscillates longitudinally, sweeping out an adjustable arc of about eighty to one hundred twenty degrees (80-120°) as aforesaid, as drum 19*a* rotates in the "mix" mode. Nozzle lance 50 is pivotal about pivot point 50*a* which is preferably formed by a medium pressure autoclave-type hose. There are numerous mechanisms that can cause the oscillation, and all of said mechanisms are within the scope of this invention. In keeping with the use of hydraulics, the preferred mechanism includes adjustable speed hydraulic motor 52 having an output shaft to which disc or cam 53 is mounted for conjoint rotation. Rigid link 54 has a first end rotatably secured to a periphery of said cam and a second end pivotally secured to nozzle lance 50 in spaced apart relation to pivot point 50*a* of said nozzle lance. Rotation of cam 53 causes rigid link 54 to displace nozzle lance 50 so that said nozzle lance 50 reciprocates about said pivot point 50*a*, much like a windshield wiper. The water pressure may be as low as fifteen thousand pounds per square inch (15,000 lbs/in$^2$) but is preferably above twenty thousand pounds per square inch (20,000 lbs/in$^2$).

The high pressure water hose that delivers water to oscillating nozzle lance 50 has a trailing part and a leading part in fluid communication with each other. The leading part is housed within elongate boom 24 and therefore is constrained to remain in a straight configuration at all times and does not flex. The trailing part extends from the source of high pressure water mounted on trailer 11 in a trailing direction and thus a bend is formed in said trailing part so that the leading end of the trailing part can connect to the trailing end of the straight first part housed within elongate boom 24.

The leading end of the leading part of high pressure water hose 26*a* (the part carried by elongate boom 24) is connected to hose coupler 51 (FIG. 6) mounted in the hollow interior of torpedo-shaped nozzle housing 26. A ninety degree swivel is housed primarily within said hose coupler 51. Hose coupler 51 is in fluid communication with saddle 51*a* that holds the ninety degree swivel that causes the path of travel of water flowing from said high pressure water hose to bend ninety degrees. The water then flows into nozzle lance 50 through medium pressure autoclave-type hose 50*a*-. Accordingly, oscillation of nozzle lance 50 does not require oscillation of the high pressure water hose, thereby eliminating the fatigue that would occur if said hose were directly connected to the nozzle lance.

Figure 7:
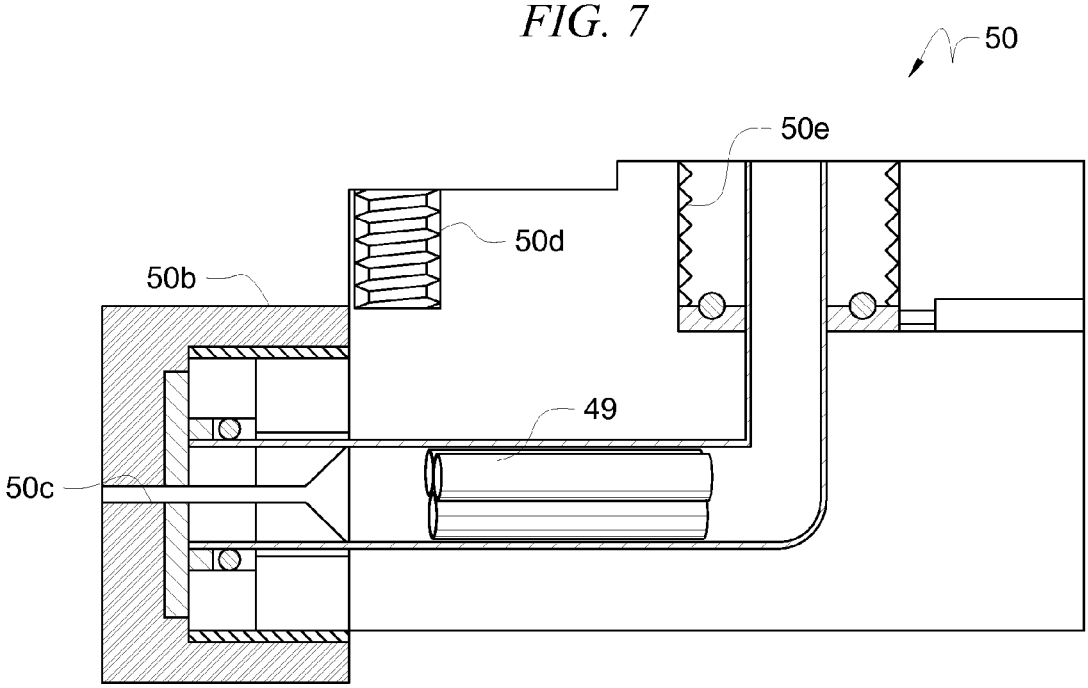
FIG. 7 is a diagrammatic longitudinal sectional view of the nozzle assembly.

Nozzle lance 50 is depicted in greater detail in FIG. 7. The preferred nozzle may be purchased from Aquajet Systems of Sweden. The nozzle may also have a diamond or tungsten carbide construction. The three (3) parallel tubes collectively denoted 49 are flow straighteners. When they are positioned in the lumen of nozzle lance 50, as depicted in FIG. 7, they subdivide said lumen into seven (7) flow passageways so that an otherwise turbulent flow of high pressure water is made into a more laminar flow, thereby enhancing the efficiency of the water stream that performs the work of hydrostatically lifting residual concrete from the drum and fins. Item 50*b* is a wear cap and nozzle holder and passageway 50*c* is the nozzle passageway that discharges the water that separates the residual concrete from the drum and the helical fins or blades. Internally threaded bore 50*d* receives an externally threaded shoulder bolt 50*a* (FIG. 6) that secures nozzle lance 50 to rigid link 54. Threaded swivel shaft 50*e* receives medium pressure autoclave-type hose 50*a* (FIG. 6).

Figure 8:
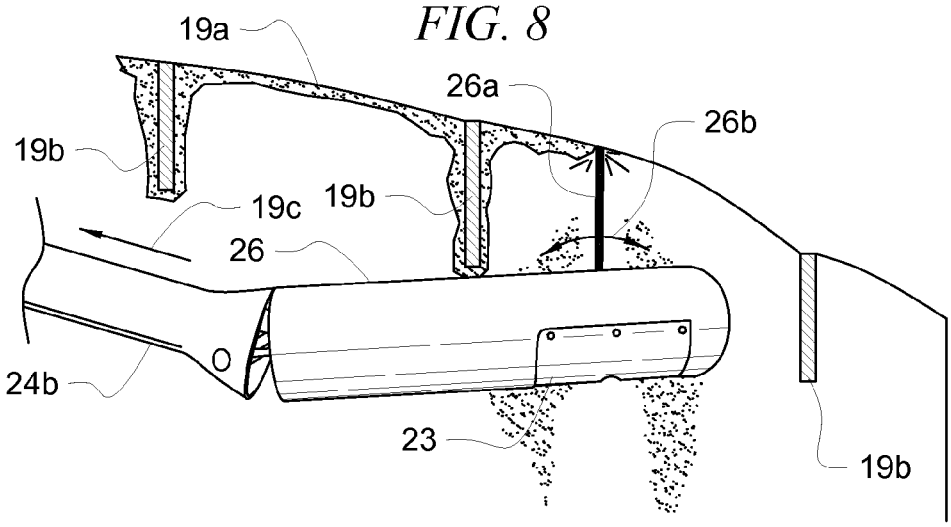
FIG. 8 is a perspective view depicting a spray impinging upon the interior wall of a rotating drum while the torpedo-shaped nozzle housing is floating over a helical fin or blade.
Figure 9:
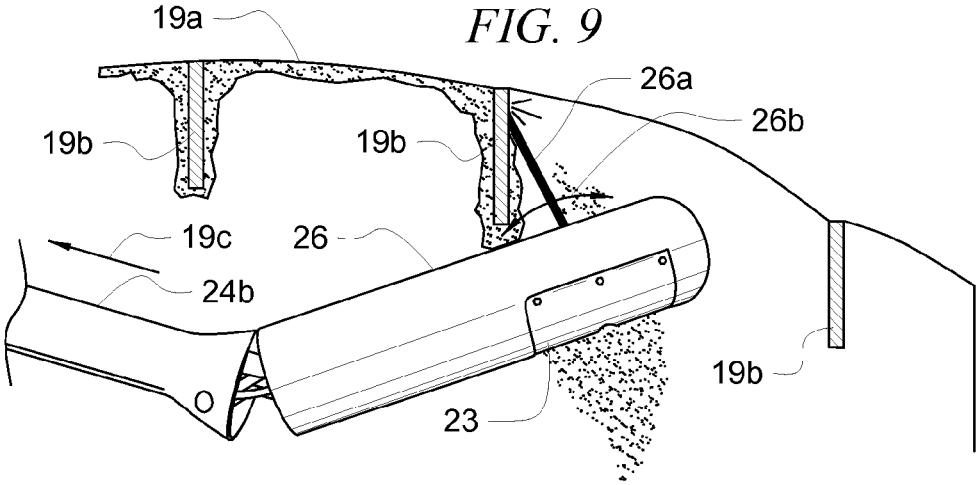
FIG. 9 is a perspective view depicting a spray impinging upon the rearward side of a helical fin.
Figure 10:
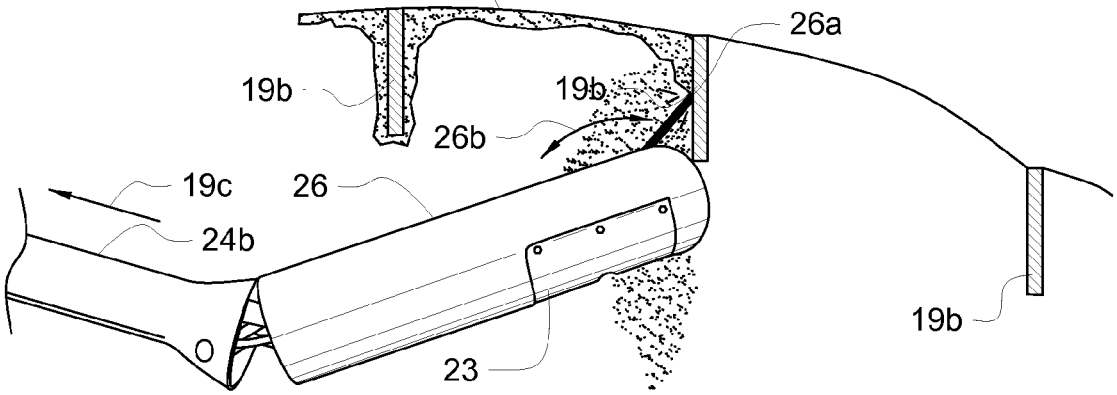
FIG. 10 is a perspective view depicting a spray impinging upon the forward side of a helical fin.

FIGS. 8, 9, and 10 diagrammatically depict how upwardly-aimed high pressure water 26*a* removes residual concrete from the top of ready mixed concrete drum 19*a*. Of course, as drum 19*a* rotates, and as elongate nozzle boom 24 is slowly retracted, in the direction of directional arrow 19*c*, from the closed end of the drum to the open end thereof, all parts thereof pass in front of the upwardly-discharged stream of very high-pressure water that is oscillating along the longitudinal axis of the drum. The unique torpedo-shaped design of the nozzle housing protects it from damage as falling chunks of removed residual concrete fall from the top of the drum. The backward and forward oscillation of water blast 26*a* is denoted by arcuate, double-headed directional arrow 26*b* in FIGS. 8, 9, and 10. Just as the rate of oscillations is controlled by varying the speed of the hydraulic motor, the length of the stroke is also controllable by varying the length of rigid link 54 (FIG. 6) or by attaching rigid link 54 to rotating cam 53 (FIG. 6) at different eccentricities to change the effective length of said rigid link.

Ready mixed concrete drum 19*a* is rotated in its mixing direction, as aforesaid, as torpedo-shaped nozzle housing 26 is retracted from said ready mixed concrete drum. Accordingly, helical fins or blades 19*b* act as an auger and displace the loose chunks of residual concrete and the water towards the closed end of drum 19*a* until the cleaning operation is complete. The drum is then placed into its discharge mode and the contents thereof are discharged through the open end of the drum in a well-known way. Both sides of the helical fins or blades are cleaned during the retraction of the nozzle. No cleaning occurs during insertion of the elongate nozzle boom into the hollow interior of the drum.

The novel apparatus works with rear-discharging and forward-discharging trucks.

Torpedo-shaped nozzle housing 26 allows nozzle lance 50 to be positioned as close as possible for a minimum stand-off distance from the residual concrete as torpedo-shaped nozzle housing 26 is retracted from ready mixed concrete drum 19*a*.

In view of the fact that the rotatably-mounted drums of most ready mixed concrete trucks are inclined about seventeen degrees (17°) from a horizontal plane, novel elongate nozzle boom 24 is typically inclined at a seventeen degree (17°) downward angle as well, with a plus or minus ten degree (+/−10°) range about said seventeen degree (17°) angle to ensure close clearance insertion of elongate nozzle boom 24 into ready mixed drum 19*a* with torpedo-shaped nozzle housing 26 in its unpivoted configuration.

Figure 11:
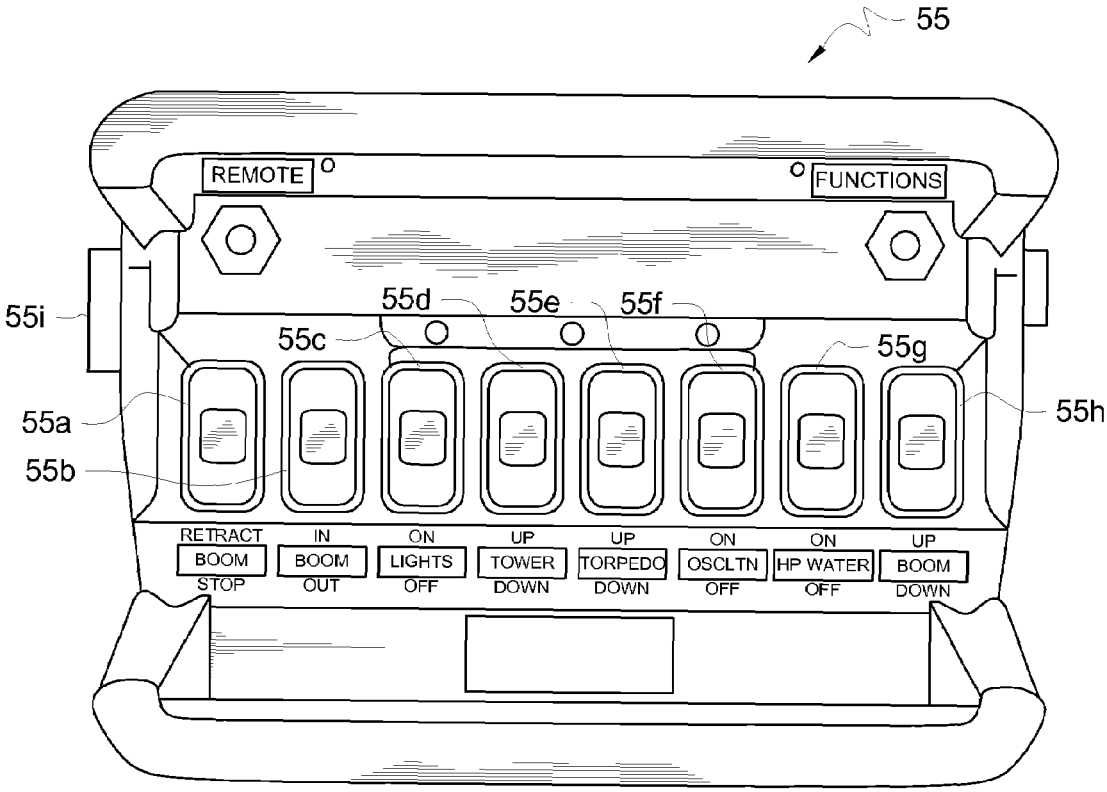
FIG. 11 is a front elevational view of a hand-held 12VDC remote control that is used to operate the apparatus depicted in FIG. 1A.

The functions of the novel ready mixed concrete truck drum cleaner are controlled by a twelve volt (12VDC) wireless remote controller. There is no one hundred twenty or two hundred twenty voltage alternating current (120-220 VAC) power cord, thereby eliminating an electrical hazard. The custom Origa® T300 (transmitter)/R160 (receiver), manufactured by Omnex Control Systems of Vancouver, British Columbia, Canada (www.omnexcontrols.com), is a suitable portable, long range, radio remote control system that includes a proprietary software program. The transmitter in this preferred embodiment includes eight (8) paddle switches, two (2) toggle switches, and is denoted 55 in FIG. 11. Activation of first paddle switch 55*a* in a first direction causes elongate boom 24 to retract and activation of the said first paddle switch in a second direction opposite to the first stops the retraction. Activation of second paddle switch 55*b* in a first direction causes elongate boom 24 to extend and activation of the said second paddle switch in a second direction opposite to the first causes retraction of the boom. The two positions of third paddle switch 55*c* turn lights, mounted on the leading end of elongate boom 24, on or off. Fourth paddle switch 55*d* raises or lowers tower 16, fifth paddle switch 55*e* controls the angle of torpedo-shaped nozzle housing 26 relative to elongate boom 24, up or down, sixth paddle switch 55*f* starts or stops the oscillation of nozzle lance 50, seventh paddle switch 55*g* turns the high pressure water on or off, and eighth paddle switch 55*h* raises or lowers elongate boom 24. An emergency stop pushbutton switch 55*i* is provided on one end of transmitter 55. The transmitter is light-in-weight and is equipped with belt clips or a shoulder strap, not depicted, so that an operator is free to walk around the novel apparatus during its operation.

Figure 12A:
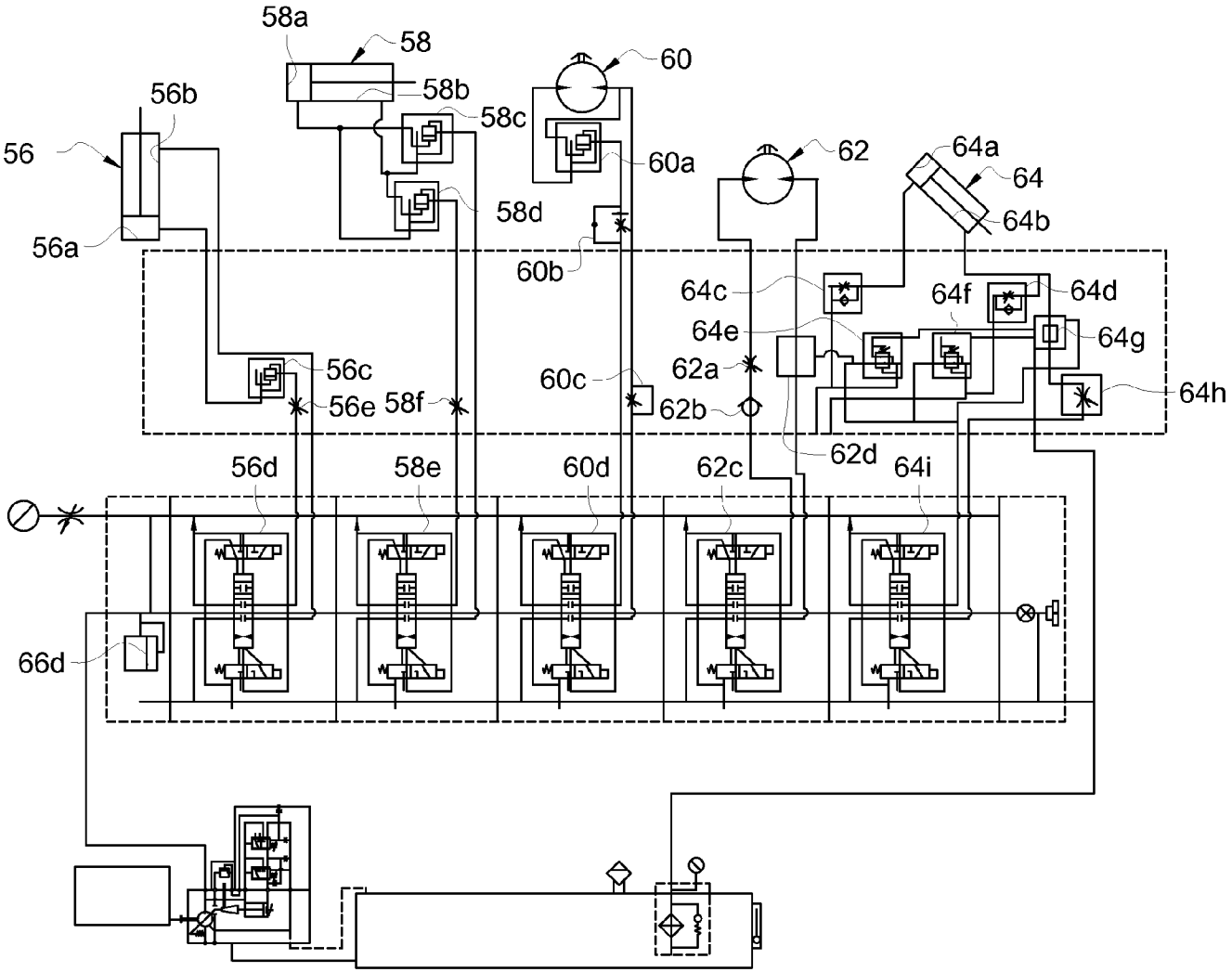
FIG. 12A is a schematic diagram of the hydraulic system circuits for lifting and lowering the tower, for tilting the elongate boom, for extending and retracting the elongate boom, for oscillating the nozzle, and for controlling the "float" of the torpedo-shaped nozzle housing.

FIG. 12A schematically depicts the hydraulic system for this invention. The blind side of tower lift cylinder 56 is denoted 55*a* and the rod side thereof is denoted 56*b*. 56*c* is the counterbalance valve for lifting elongate boom 24 and 56*d* is an up/down solenoid control valve. 56*e* is a needle valve for speed control. The blind side of cylinder 58 that tilts elongate boom 24 is denoted 58*a* and the rod side thereof is denoted 58*b*. 58*c* and 58*d* are counterbalance valves for tilt. 58*e* is an up/down solenoid control valve and 58*f* is a needle valve for speed control. Hydraulic motor 60 extends and retracts elongate boom 24. Its control circuit includes adjustable flow control valve 60*b*, adjustable flow control valve 60*c*, and extend-retract solenoid control valve 60*d*. Nozzle oscillation motor 62 includes pressure-reducing valve 62*a*, check valve 62*b*, on/off solenoid control valve 62*c*, and adjustable needle control valve 62*d* for controlling the speed of nozzle oscillation.

Figure 12B:
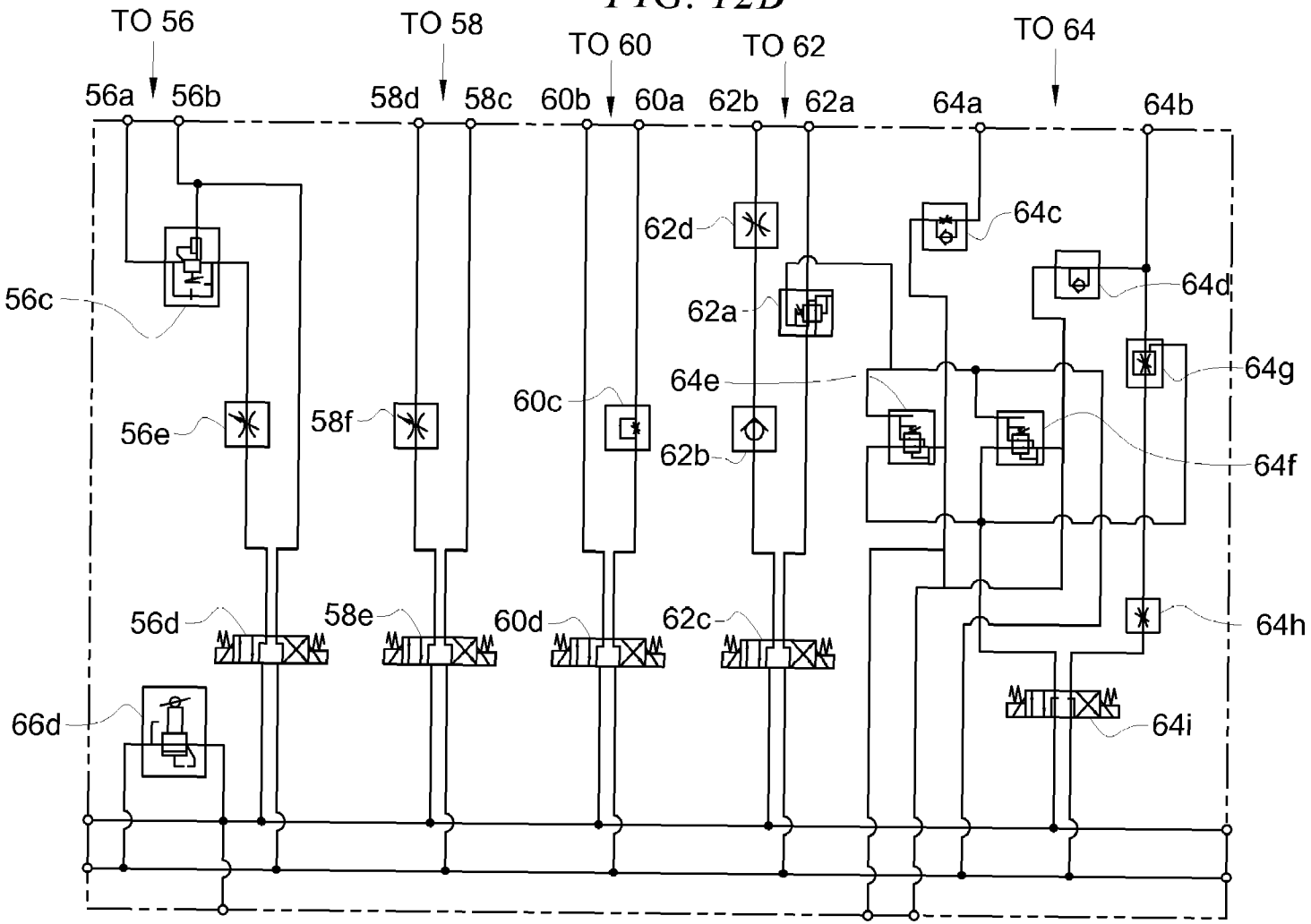
FIG. 12B is a schematic diagram of the hydraulic manifold and its internals for controlling the raising and lowering of the tower, the tilting of the elongate boom, the retraction and extension of the elongate boom, the nozzle oscillation, and the "float" control circuit.
Figure 12C:
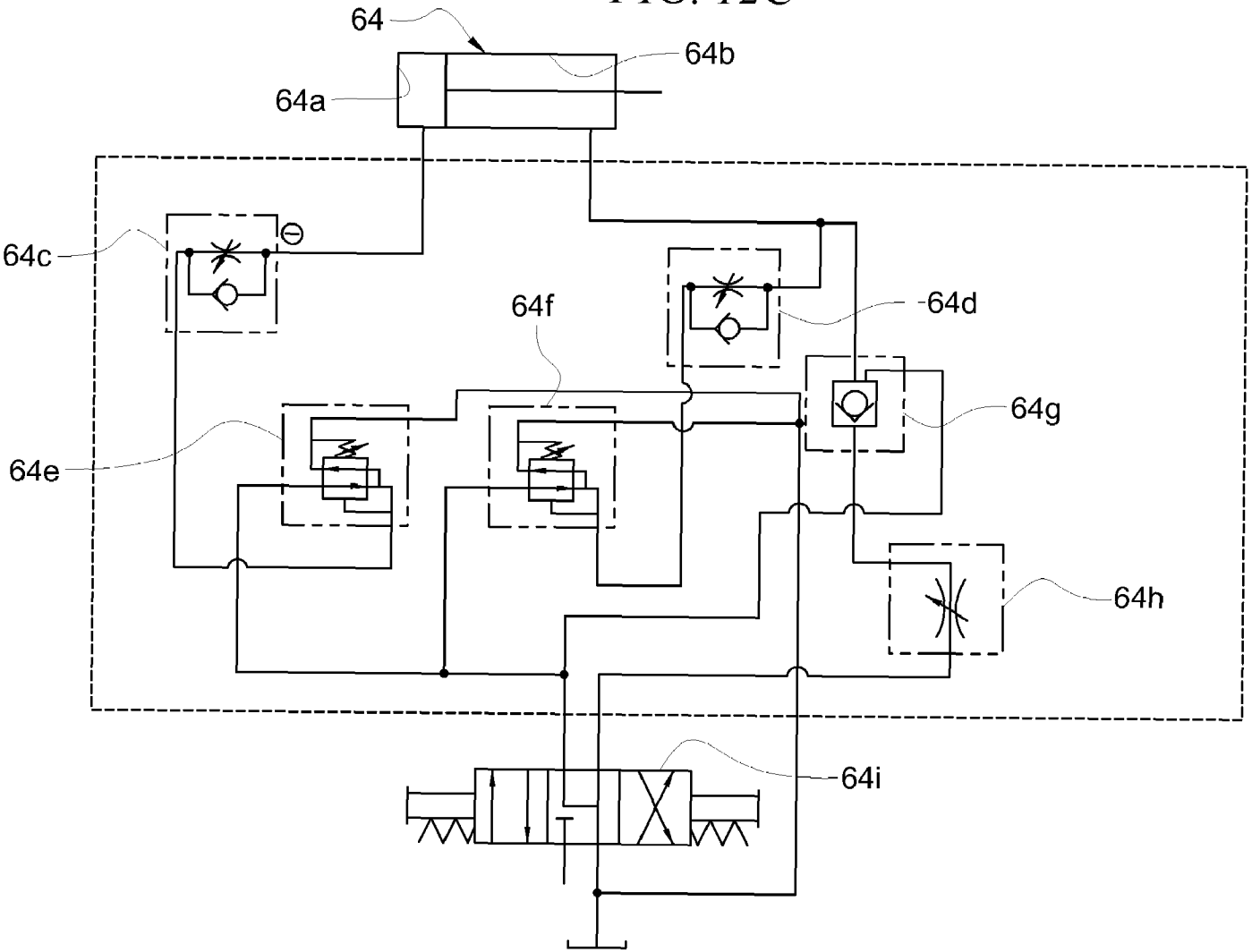
FIG. 12C is a schematic diagram of the "float" control circuit for the torpedo-shaped nozzle housing only.

As best understood in connection with FIGS. 12A and 12C, the control circuit for torpedo float cylinder 64 includes blind side 64*a*, rod side 64*b*, adjustable flow control valve 64*c* for the "Down" and "Float" positions, adjustable flow control valve 64*d* for the "Up" and "Float" positions, pressure reducing valve 64*e* (1500 psi), pressure-reducing valve 64*f* (500 psi), pressure-operated pilot stop valve 64*g* to isolate the float control circuit, adjustable flow needle valve 64*h* for pressure down, and solenoid control valve 64*i*.

The circuitry for the hydraulic manifold internals is schematically depicted in FIG. 12B. Just as in FIG. 12A, the "Up-Down" hydraulic connections for tower 16 are denoted 56. Item 56*c* is a counter balance valve as aforesaid in connection with FIG. 12A, 56*d* is a solenoid control valve as aforesaid, and 56*e* is a speed control needle valve as aforesaid. Item 66*d* is a system pressure regulator that maintains the system pressure at about 2800 psi.

As in FIG. 12A, the "Up-Down" hydraulic circuit for tilting elongate boom 24 is denoted 58 in FIG. 12B. Items 58*c* and 58*d* are counterbalance valves as aforesaid. Item 58*c* is a solenoid control valve as aforesaid and item 58*f* is a speed control needle valve as aforesaid.

The circuitry for the hydraulic circuit that controls extension and retraction of elongate boom 24 includes hydraulic connections 70, speed control needle valve 70*a* and solenoid control valve 70*b*.

The nozzle oscillation motor is controlled by circuitry denoted 72. Item 72*a* is a pressure reducing valve. 72*b* is a check valve and 72*c* is a solenoid control valve.

The torpedo float cylinder is denoted 64 in FIGS. 12 A-C. The elements that collectively form the hydraulic control circuit are described above in connection with FIG. 12A-B. They are disclosed in increased detail in FIG. 12C because of the importance of the hydraulics that controls the "floating" action of the torpedo-shaped nozzle housing.

The hydraulic control circuits for the cylinder that lifts and lowers tower 16, the cylinders that cause inclination or tilting of elongate boom 24, the circuitry for controlling the hydraulic motor that extends and retracts elongate boom 24, and the circuitry that controls the hydraulic motor that effects oscillation of nozzle lance 50 are well within the level of ordinary skill of those who work in the hydraulic arts so the details thereof need not be disclosed with particularity.

To use the novel apparatus, an operator inserts torpedo-shaped nozzle housing 26 and elongate boom 24 into rotating drum 19*a* (paddle switch 55*b*) and turns on the high pressure water (paddle switch 55*g*) after the torpedo-shaped nozzle housing 26 is fully inserted into said drum 19*a*. The torpedo-shaped nozzle housing 26 remote control paddle switch 55*e* is then pressed into its "Up" position. The torpedo solenoid valve, denoted 64*i* in FIG. 12A and 12C, shifts to apply pressure to the pressure reducing control valves and the pilot operated valve to isolate the float circuit. Pressure reducing valve 64*e* is set at approximately fifteen hundred pounds per square inch (1500 lbs/in$^2$) and is connected to the blind side of the torpedo float cylinder and extends the float cylinder rod to raise up torpedo-shaped nozzle housing 26 with just enough force to counteract the high pressure water thrust and the weight of said torpedo-shaped nozzle housing. Pressure-reducing control valve 64*f* is set to approximately five hundred psi (500 lbs/in$^2$) and enables the soft float of torpedo-shaped nozzle housing 26 over helical fins or blades 19*b* as they are encountered, due to the differential pressure across the cylinder piston at all times while being forced down by such fins or blades and then returning to the "Up" position upon clearing each fin or blade. The "Up" position is the position where the nozzle is closely spaced to the residual concrete between the fins or blades, said position being referred to herein as the "stand-off" distance.

The speed and movement of torpedo-shaped nozzle housing 26 are controlled by the opposite side adjustable flow control valves 64*c* and 64*d* that maintain a positive upward force on said torpedo-shaped nozzle housing at all times. Moving remote control torpedo paddle switch 55*e* to the "Down" position causes solenoid 64*i* to shift and release pressure from the pressure-reducing control valves and opens the pilot-operated isolation valve. The pressure is therefore applied to the "rod" side of the torpedo float cylinder, thereby forcing it straight down again.

The novel structure enables torpedo-shaped nozzle housing 26 to "float," maintaining a close, highly efficient stand-off distance between nozzle lance 50 and residual concrete to be removed when torpedo-shaped nozzle housing 26 is between fins or blades 19*b*, with just enough upward force to enable said torpedo-shaped nozzle housing to be pushed downwardly by said fins or blades as it slides over said fins or blades, and returning to the close stand-off distance upon clearing each fin or blade as the torpedo-shaped nozzle housing is slowly retracted from the drum. The novel system works for drums of ready mixed concrete trucks of many differing sizes without afflicting damage to said fins, blades, drums or to the torpedo-shaped nozzle housing.

In the event a concrete truck is developed that has discontinuous fins, or fins that are not helical, it is clear that using the novel apparatus herein would apply to such truck without restriction to the embodiments disclosed herein that refer to a truck having continuous helical fins or blades. Moreover, in the event a truck is developed that has no fins or blades yet remains capable of mixing concrete with some other means, the cleaning of such a truck with the novel apparatus would still infringe the claims that follow because said fins or blades are not a part of the invention as indicated in said claims.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apparatus for removing residual concrete from a rotatably mounted ready mixed concrete truck drum, comprising:

an elongate boom adapted to be inserted into said drum along a longitudinal axis of symmetry of said drum, said longitudinal axis of symmetry also being an axis of said drum;

a torpedo-shaped nozzle housing hingedly connected to a leading end of said elongate boom so that said torpedo-shaped nozzle housing is positionable in an infinite number of angular positions relative to said elongate boom;

said torpedo-shaped nozzle housing having a storage and insertion position where said torpedo-shaped nozzle housing is disposed in axial alignment with said elongate boom;

control means for controlling the angular position of said torpedo-shaped nozzle housing relative to said elongated boom;

a high-pressure water nozzle lance mounted within said torpedo-shaped nozzle housing;

oscillating means to cause said high-pressure water nozzle lance to oscillate in a vertical plane about a horizontal axis;

said high-pressure water nozzle lance being mounted so that it points straight up at a center of its oscillation;

said high-pressure water nozzle lance oscillating to either side of said center of oscillation;

an elongate hose extending between a source of water under high-pressure water nozzle lance;

said truck adapted to have a plurality of helical fins mounted within said drum, each of said helical fins having a leading side and a trailing side, and said high pressure water nozzle being adapted to clean concrete from both sides of each helical fin as said torpedo-shaped nozzle housing is retracted from an interior of said drum;

said high pressure water nozzle lance further adapted to cut, blast, and remove green and hardened concrete from an interior drum shell of said drum and between said helical fins;

said high pressure water nozzle being positioned radially outwardly of a longitudinal axis of symmetry of said drum to reduce a distance between said high pressure water nozzle lance and the residual concrete to be blasted removed;

a float control that maintains said high pressure water nozzle lance in very close proximity to said helical fins and said interior drum shell as said torpedo-shaped nozzle housing is retracted; and said float control enabling said torpedo-shaped nozzle housing to contact and slide over each helical fin as it is encountered and further enabling said torpedo-shaped nozzle housing to return to said very close proximity to said interior drum shell upon clearing each helical fin;

said high-pressure water nozzle lance blasting and removing concrete from a trailing side of a helical fin as said torpedo-shaped nozzle housing slides up, across, and over a helical fin during retraction of said elongate boom;

said high-pressure water nozzle lance blasting and removing concrete from a leading side of a helical fin as said torpedo-shaped nozzle housing slides down a helical fin during retraction of said elongate boom;

said high-pressure water nozzle lance also blasting and removing concrete from said interior drum shell and between helical fins during retraction of said elongate boom;

whereby rotation of said ready mixed concrete drum in a direction adapted to mix concrete and discharge of high-pressure water from said high-pressure water nozzle lance during said rotation causes hydraulic separation of residual concrete from an upper interior drum shell of said ready mixed concrete drum;

whereby rotation of said ready mixed concrete drum in a direction adapted to discharge concrete causes said helical fins to discharge the residual concrete and water removed by the action of said high pressure water; and whereby blasting and removing concrete from said interior drum shell fins of said drum is performed with high efficiency because said float control maintains the high pressure water nozzle lance at said close proximity from the green and hardened concrete as said torpedo-shaped nozzle housing is retracted from said drum.

2. The apparatus of claim 1, further comprising:

said high-pressure water nozzle lance having an adjustable angle of oscillation having a range of motion of approximately eighty to about one hundred twenty degrees and fully adjustable.

3. The apparatus of claim 1, further comprising:

said oscillating means including an oil-driven hydraulic motor having an output shaft;

a disc mounted on said output shaft for conjoint rotation therewith;

a rigid link having a first end rotatably mounted to said disc in eccentric relation thereto and a second end pivotally secured to said high-pressure water nozzle lance in spaced relation to said pivot point;

whereby rotation of said disc creates and effects oscillation of said high-pressure water nozzle lance and;

whereby the energy of high-pressure water traveling through said high-pressure water nozzle lance is not harnessed to drive any motion of said high-pressure water nozzle lance for blasting and removing of concrete purposes because said apparatus uses hydraulic oil under pressure from a hydraulic pump to drive motion of said high-pressure water nozzle lance;

whereby the energy supplied to the high-pressure water nozzle for blasting and removing concrete is not depleted.

4. The apparatus of claim 1, further comprising:

an upstanding tower;

a hydraulic motor mount housing, having a hollow interior, positioned in surmounting relation to said upstanding tower;

a boom housing of straight configuration having a hollow interior and open ends, said boom housing mounted in surmounting relation to said hydraulic motor mount housing;

said boom housing being pivotally mounted with respect to said hydraulic motor mount housing;

said boom housing having a position of repose where a longitudinal axis of said boom housing is disposed normal to a longitudinal axis of said upstanding tower;

said elongate boom disposed at least in part within said hollow interior of said boom housing;

said elongate boom having a leading end extending from a leading end of said boom housing, a trailing end extending from a trailing end of said boom housing, and a medial extent disposed within said boom housing;

said elongate boom having a retracted position where said leading end of said elongate boom is disposed close to said boom housing and where said trailing end of said elongate boom is disposed remote from said boom housing;

said elongate boom having an extended position where said leading end of said elongate boom is remotely disposed relative to said boom housing and where said trailing end of said elongate boom is disposed close to said boom housing; and said torpedo-shaped nozzle housing having a storage and insertion position where said torpedo-shaped nozzle housing is disposed in axial alignment with said elongate boom.

5. The apparatus of claim 4, further comprising:

an elongate rack gear secured to an underside of said elongate boom;

said elongate rack gear being disposed within said boom housing;

a pinion gear disposed in meshing engagement with said rack gear so that rotation of said pinion gear in a first direction extends said elongate boom and in a second direction retracts said elongate boom;

a hydraulic motor having an output shaft;

said hydraulic motor being mounted on said motor mount housing, externally thereof;

said pinion gear being mounted on said output shaft for conjoint rotation therewith;

said pinion gear being mounted in said hollow interior of said motor mount housing.

6. The apparatus of claim 5, further comprising:

said hydraulic motor being an oil-driven hydraulic motor.

7. The apparatus of claim 4, further comprising:

said upstanding tower having a tube-in-tube construction so that a height of said tower is adjustable from a fully extended elevated position to a fully retracted low position and an infinite plurality of positions therebetween.

8. The apparatus of claim 7, further comprising:

said tube-in-tube construction including a lower tube and an upper tube;

a hinge means for hingedly interconnecting said upper tube and said elongate boom;

said hinge means including a top plate disposed in surmounting relation to said upper tube;

said hinge means including a support plate disposed in underlying relation to said elongate boom;

said hinge means including a hinge post for hingedly interconnecting said top plate and said support plate;

said support plate being disposed at an angle to said top plate when said elongate boom is disposed at an angle relative to said motor mount housing, said angle between said top and support plates being equal to the angle between said elongate boom and said motor mount housing.

9. The apparatus of claim 8, further comprising:

a hydraulic cylinder disposed in interconnecting relation to said motor mount housing and said upper tube;

a first end of said hydraulic cylinder being pivotally connected to a proximal end of said motor mount housing;

a second end of said hydraulic cylinder being pivotally secured to said upper tube;

whereby extension of said hydraulic cylinder causes pivotal movement of said motor mount housing and said elongate boom; and whereby full retraction of said hydraulic cylinder positions said motor mount housing and said elongate boom in a horizontal plane.

10. The apparatus of claim 7, further comprising:

a first and second control means mounted on said observation tower;

said first control means adapted to control the insertion and retraction speed of said elongate boom;

said second control means adapted to control the speed of oscillation of said nozzle.

11. The apparatus of claim 4, further comprising:

said elongate boom being pivotally mounted with respect to said motor mount;

said elongate boom having an unpivoted position of repose where it is disposed substantially horizontally;

said elongate boom having a first pivoted position where it is disposed at an angle of about seventeen degrees (17°) relative to a horizontal plane.

12. The apparatus of claim 11, further comprising:

said elongate boom having a second pivoted position where it is disposed at an angle of about thirty four degrees (34°) relative to a horizontal plane.

13. The apparatus of claim 4, further comprising:

an elongate, flexible hose handler;

a first plurality of hydraulic hoses and a first high pressure water hose housed within said elongate boom;

a second plurality of hydraulic hoses and a second high pressure water hose housed within said flexible hose handler; and said first and second plurality of hydraulic hoses and said first and second high pressure water hoses being respectively connected to one another at a trailing end of said elongate boom, said elongate, flexible hose handler having a leading end disposed in close proximity to said trailing end of said elongate boom.

14. The apparatus of claim 13, further comprising:

said torpedo-shaped nozzle housing having a longitudinally-extending slot formed therein;

an oil-driven hydraulic motor mounted within a hollow interior of said torpedo-shaped nozzle housing;

said oil-driven hydraulic motor powering the oscillation of said high-pressure water nozzle lance;

said second plurality of hydraulic hoses providing fluid communication between a source of hydraulic fluid and said oil-driven hydraulic motor;

said oil-driven hydraulic motor having an output shaft;

a disc secured to said output shaft for conjoint rotation therewith;

a first end of a rigid link secured to said disc near an outer periphery of said disc;

a second end of said rigid link connected to said nozzle;

whereby rotation of said output shaft effects oscillation of said rigid link and hence oscillation of said nozzle.

15. The apparatus of claim 14, further comprising:

a hose connector mounted within the hollow interior of said torpedo-shaped nozzle housing;

said hose connecter adapted to receive a leading end of said second high pressure water hose;

a ninety degree swivel mounted in said hollow interior of said nozzle housing;

said ninety degree swivel having an input port in fluid communication with said hose connector so that high pressure water flowing from said second high pressure water hose is constrained to follow a path of travel that bends ninety degrees; and said ninety degree swivel having an output port in fluid communication with said high pressure water nozzle lance;

whereby said second high pressure water hose is mounted independently of said high-pressure water nozzle lance and is therefore not flexed as said high-pressure water nozzle lance oscillates.

16. The apparatus of claim 4, further comprising, a transportable trailer system for supporting said elongate nozzle boom, said upstanding tower, said torpedo-shaped nozzle housing, said upstanding post, and said motor mount housing;

a back-up assistance assembly that facilitates interconnection of said transportable trailer system and a ready mixed concrete truck;

whereby said transportable trailer system may be stationary or truck-mounted.

17. The apparatus of claim 1, further comprising:

said float control including a torpedo float cylinder having a blind side pressurized to urge the torpedo-shaped nozzle housing toward the interior wall of said drum and having a rod side pressurized to urge the torpedo-shaped nozzle housing down when a helical fin is encountered; and said float control further including a first and second pressure regulator, each of which is adjustable for desired compensation of any pressure and flow reaction force.

18. The apparatus of claim 10, further comprising:

said float control further including an adjustable flow control valve.

19. The apparatus of claim 18, further comprising:

a line reel rotatably mounted on a side of the trailer corresponding to the side of the truck where the driver sits;

a pipe and a plate positioned near said side of said truck where said driver sits;

whereby an elongate line is played out to said pipe and plate from said line reel in parallel alignment with a common longitudinal axis of symmetry of the truck and trailer up to a point where it can be seen by said driver;

whereby said driver aligns the trailer with the line and backs up until the wheel chocks are encountered; and whereby the line is reeled back onto its reel after said trailer is properly positioned with respect to the ready mixed concrete truck.

20. An apparatus for removing residual concrete from a rotatably mounted ready mixed concrete truck drum, comprising:

an elongate boom;

a torpedo-shaped nozzle housing hingedly connected to a leading end of said elongate boom so that said torpedo-shaped nozzle housing is positionable in an infinite number of angular positions relative to said elongate boom;

a high-pressure water nozzle lance mounted within said torpedo-shaped nozzle housing;

an elongate hose extending between a source of water under high pressure and said high-pressure water nozzle lance;

said truck adapted to have a plurality of helical fins mounted within said drum, each of said helical fins having a leading side and a trailing side, and said high pressure water nozzle lance being adapted to clean concrete from both sides of each helical fin as said torpedo-shaped nozzle housing is retracted from an interior of said drum;

said high pressure water nozzle further adapted to clean residual concrete from said interior drum shell of said drum between said helical fins;

a float control that maintains said high pressure water nozzle in very close proximity to said helical fins and said interior drum shell as said torpedo-shaped nozzle housing is retracted;

said float control enabling said torpedo-shaped nozzle housing to contact and slide over each helical fin as it is encountered and further enabling said torpedo-shaped nozzle housing to return to said very close proximity to said interior drum shell upon clearing each helical fin, said close proximity substantially increasing the blasting and removing capability of said high-pressure water nozzle lance;

an upstanding tower;

a hydraulic motor mount housing, having a hollow interior, positioned in surmounting relation to said upstanding tower;

a boom housing of straight configuration having a hollow interior and open ends, said boom housing mounted in surmounting relation to said hydraulic motor mount housing;

said boom housing being pivotally mounted with respect to said hydraulic motor mount housing;

said boom housing having a position of repose where a longitudinal axis of said boom housing is disposed normal to a longitudinal axis of said upstanding tower;

said elongate boom disposed at least in part within said hollow interior of said boom housing;

said elongate boom having a leading end extending from a leading end of said boom housing, a trailing end extending from a trailing end of said boom housing, and a medial extent disposed within said boom housing;

said elongate boom having a retracted position where said leading end of said elongate boom is disposed close to said boom housing and where said trailing end of said elongate boom is disposed remote from said boom housing;

said elongate boom having an extended position where said leading end of said elongate boom is remotely disposed relative to said boom housing and where said trailing end of said elongate boom is disposed close to said boom housing;

said torpedo-shaped nozzle housing having a storage and insertion position where said torpedo-shaped nozzle housing is disposed in axial alignment with said elongate boom;

an interconnecting means for interconnecting said torpedo-shaped nozzle housing and said elongate boom;

control means for controlling the angular position of said torpedo-shaped nozzle housing relative to said elongate boom;

a transportable trailer system that may be stationary including truck mounted for supporting said elongate nozzle boom, said upstanding tower, said torpedo-shaped nozzle housing, said upstanding post, and said motor mount housing;

a back-up assistance assembly that facilitates interconnection of said transportable trailer and a ready mixed concrete truck;

said back-up assistance assembly including a longitudinal rod having a first end pivotally secured to a trailing end of said trailer;

a transverse rod connected to said longitudinal rod to form a "T" -shaped connection therewith;

a first pair of truncate rods mounted to and extending longitudinally from a first half of said transverse rod;

a second pair of truncate rods mounted to and extending longitudinally from a second half of said transverse rod;

a first flat plate having an upwardly protruding first wheel chock formed thereon;

said first flat plate being positioned between but not connected to said first pair of truncate rods;

a second flat plate having an upwardly protruding wheel chock formed thereon; and said second flat plate being positioned between but not connected to said second pair of truncate rods formed in said second half of said transverse rod;

whereby a driver of a ready mixed concrete truck backs onto the first and second flat plates until the wheels are stopped by the wheel chocks; and whereby the length of said longitudinal rod is preselected to ensure that the truck will be properly spaced from the novel apparatus when the wheels of the ready mixed concrete truck abut said wheel chocks.

* * * * *